US009663889B2

(12) United States Patent
Kim et al.

(10) Patent No.: US 9,663,889 B2
(45) Date of Patent: May 30, 2017

(54) LAUNDRY TREATING APPARATUS

(71) Applicant: LG ELECTRONICS INC., Seoul (KR)

(72) Inventors: Keunjoo Kim, Seoul (KR); Jinwoong Kim, Seoul (KR); Seungchul Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 33 days.

(21) Appl. No.: 14/626,420

(22) Filed: Feb. 19, 2015

(65) Prior Publication Data

US 2015/0233040 A1 Aug. 20, 2015

(30) Foreign Application Priority Data

Feb. 20, 2014 (KR) ..... 10-2014-0019615

(51) Int. Cl.

| | |
|---|---|
| ***D06F 37/22*** | (2006.01) |
| ***D06F 37/20*** | (2006.01) |
| *D06F 33/02* | (2006.01) |
| *D06F 37/06* | (2006.01) |

(52) U.S. Cl.

CPC ..... *D06F 37/225* (2013.01); *D06F 37/203* (2013.01); *D06F 33/02* (2013.01); *D06F 37/06* (2013.01); *D06F 2222/00* (2013.01)

(58) Field of Classification Search

CPC ..... D06F 37/225; D06F 37/203; D06F 33/02; D06F 37/06

USPC ... 68/23.2, 12.06, 140, 139, 23.1, 200, 23.5, 68/12.02, 12.14, 12.19; 74/572.4, 570.1, 74/573.11, 86, 570.2, 570.21; 210/144, 210/363, 380.2, 147, 381

See application file for complete search history.

(56) References Cited

U.S. PATENT DOCUMENTS

| | | | | |
|---|---|---|---|---|
| 2012/0144598 | A1 | 6/2012 | Ostdiek et al. | |
| 2013/0031939 | A1 * | 2/2013 | Hasanreisoglu | D06F 37/065 68/139 |
| 2015/0075229 | A1 * | 3/2015 | Malheiros | D06F 37/225 68/140 |

FOREIGN PATENT DOCUMENTS

| | | | | |
|---|---|---|---|---|
| EP | 1655404 | A1 | 5/2006 | |
| EP | 1693500 | A2 * | 8/2006 | D06F 37/225 |

OTHER PUBLICATIONS

Pfenninger Peter, "Washing Machine with tanks for unbalance compensation", Aug. 2006, EP 1693500—Machine Translation.*

* cited by examiner

*Primary Examiner* — David Cormier
*Assistant Examiner* — Thomas Bucci
(74) *Attorney, Agent, or Firm* — Dentons US LLP

(57) ABSTRACT

A laundry treating apparatus including a cabinet comprising a laundry introduction hole formed therein to introduce laundry, a drum rotatably provided in the cabinet, the drum comprising a drum introduction hole, formed in a front surface thereof, in communication with the laundry introduction hole, at least three main balancers provided in the drum defining a space where liquid is stored, the balancers being spaced apart at preset angle intervals with respect to a rotation axis of the drum, and a sub balancer provided at the drum to provide a circulation of the liquid, the sub balancer increasing load of the drum locally by flowing the liquid stored in the circulation passage to the lowest point of a drum rotation locus based on a rotation speed of the drum.

14 Claims, 12 Drawing Sheets

(a)

(b)

LAUNDRY TREATING APPARATUS

CROSS-REFERENCE TO RELATED APPLICATIONS

Pursuant to 35 U.S.C. §119(a), this application claims the benefit of earlier filing date and right of priority to Korean Application No. 10-2014-0019615, filed on Feb. 20, 2014, the entire contents of which is hereby incorporated by reference herein in its entirety.

BACKGROUND

Field

Embodiments of the present disclosure relate to a laundry treating apparatus.

Discussion of the Related Art

A conventional laundry treating apparatus includes a cabinet forming an exterior appearance, a tub mounted in the cabinet, a drum rotatably mounted in the tub to wash laundry held therein and a motor having a shaft fixed to the drum through the tub to rotate the drum.

According to the location of laundry loaded in the drum, the drum may be unbalanced when rotated (i.e., not keeping a dynamic balance).

Dynamic balance means a state where a centrifugal force or a moment made by the centrifugal force when a rotary body is rotated is 0 (zero) with respect to a rotation axis. A dynamic balance of a rigid body is maintained when the mass distribution is uniform with respect to a rotation axis.

Accordingly, it can be understood that dynamic balance of a laundry treating apparatus means a state where the mass distribution of laundry with respect to a shaft of a drum (i.e., a rotational axis) is in an allowable range, when a drum is rotated with laundry held therein (i.e., a state where the vibrations of the rotating drum are in an allowable range)

Meanwhile, a state where the dynamic balance is lost in a laundry treating apparatus (i.e., an unbalance state) means that mass distribution of laundry with respect to a shaft (rotational axis) is not uniform while a drum is rotated. The unbalance state may be generated when the laundry is not distributed uniformly.

When the drum rotates in the unbalance state vibration is generated. The vibration of the drum could be transferred to a tub or a cabinet, such that the transferred vibration might cause a noise problem in the laundry treating apparatus.

One of conventional laundry treating apparatuses includes a balancing unit for improving unbalance of a drum. Such balancing units provided in conventional laundry treating apparatuses may be fixed to a tub, with balls or liquid provided in a closed housing.

The rotation speed of the unbalanced drum is the highest when the laundry causing unbalance is passing the lowest point of a drum rotation locus and the rotation speed is the lowest when the laundry causing the unbalance is passing the highest point of the drum rotation locus.

Balls or liquid provided in a conventional balancing unit may be configured to move towards the lowest point of the drum rotation locus when the laundry causing the unbalance to move towards the highest point, to control the unbalance.

However, while the unbalance control system/method mentioned above is effective in a steady state where the vibration of the drum is within a preset range, the unbalance control is expected to be often present in a transient state (i.e., a transient vibration state) before the steady state.

Additionally, it is difficult to immediately improve the unbalance (i.e., to actively ease the unbalance) in the structure of the conventional balancing unit, when the unbalance is generated.

SUMMARY

Embodiments of the present invention provide a laundry treating apparatus which may actively improve unbalanced rotation of a drum in which laundry is held.

Embodiments of the present invention also provide a laundry treating apparatus which may improve the unbalance of the drum by supplying liquid to means for agitating the laundry held in the drum.

Embodiments of the present invention also provide a laundry treating apparatus which may improve a longitudinal direction plane unbalance of the drum as well as a diameter direction plane unbalance of the drum.

Embodiments of the present invention also provide a laundry treating apparatus which may improve the unbalance of the drum by providing a passage through which liquid is circulated along a direction equal to a rotation direction of the drum or a reverse direction of the rotation direction of the drum when the drum is rotated.

Embodiments of the present invention also provide a laundry treating apparatus including a cabinet including a laundry introduction hole formed therein to load laundry; a drum rotatably provided in the cabinet, the drum comprising a drum introduction hole, formed in a front surface thereof, in communication with the laundry introduction hole; at least three main balancers provided in the drum defining a space where liquid is stored, wherein the balancers are spaced apart at preset angle intervals with respect to a rotation axis of the drum; and a sub balancer provided at the drum to provide a circulation of the liquid, the sub balancer increasing load of the drum locally by flowing the liquid stored in the circulation passage to the lowest point of a drum rotation locus based on a rotation speed of the drum.

The sub balancer may exhaust the liquid stored in the circulation passage outside the circulation passage based on the rotation speed of the drum.

Each of the main balancers may exhaust the liquid stored therein outside the drum based on a rotation angle of the drum and the rotation speed of the drum.

The laundry treating apparatus may further include a supplier selectively supplying the liquid to the main balancer and the sub balancer.

The sub balancer may include a balancer body extended toward the laundry introduction hole from the front surface of the drum, with a diameter larger than a diameter of the drum introduction hole; and a balancer flange bent toward the drum introduction hole from the balancer body to provide a space through which the liquid injected by the supplier is drawn into the balancer body.

The sub balancer may further include a plurality of balancer partition walls projected toward the drum introduction hole from the balancer body.

A distance from the balancer body to a free end of the balancer partition wall may be smaller than a distance from the balancer body to a free end of the balancer flange.

Each of the main balancers may be projected toward a rotation axis of the drum from an inner circumferential surface of the drum.

Each of the main balancer may include a storage body fixed to the inner circumferential surface of the drum to define a space where the liquid is stored; an inlet through which the liquid is drawn into the storage body; and an outlet through which the liquid stored in the storage body is exhausted outside the drum, and the drum may further include a balancer inlet hole in communication with the inlet provided in each of the main balancers; and a passage unit provided in the front surface of the drum to guide the liquid supplied by the supplier to the balancer inlet hole provided in each of the main balancers.

Each of the main balancer may further include a guide passage connected to the inlet to guide the liquid drawn through the inlet toward an edge of the storage body from a center of the storage body.

The passage unit may include a first passage body provided between the drum introduction hole and the balancer body, extended toward the laundry introduction hole from the front surface of the drum; a first flange bent toward the drum introduction hole from the first passage body to provide a space through which the liquid injected by the supplier is drawn into the first passage body; and a first passage partition wall provided in the first passage body, inserted in the balancer inlet hole provided in each of the main balancer, to partition off an internal space of the first passage body into a preset number of spaces equal to the number of the balancers.

The first passage body may further include an inclined surface guiding the liquid stored in the sub balancer to be exhausted outside.

The passage unit may include a first passage body provided between the drum introduction hole and the balancer body, inclined toward the laundry introduction hole from the front surface of the drum; and a first passage partition wall provided in the first passage body, inserted in the balancer inlet hole provided in each of the main balancers, to partition off an internal space of the first passage body into a preset number of spaces equal to the number of the balancers.

Each of the main balancers may include a storage body fixed to an inner circumferential surface of the drum, the storage body comprising a front space toward the front surface of the drum and a rear space toward a rear surface of the drum; a first inlet and a second inlet through which the liquid is drawn into the front space; a guide passage guiding the liquid drawn through the second inlet to the rear space; and an outlet through which the liquid stored in the storage body is exhausted outside the drum, and the drum may further include a front inlet hole in communication with the first inlet; a rear inlet hole in communication with the second inlet; and a passage unit provided in the front surface of the drum, the passage unit comprising a first passage guiding the liquid supplied by the supplier to one of the front and rear inlet holes and a second passage guiding the liquid supplied by the supplier to the other one of the front and rear inlet holes.

The first passage may include a first passage body provided between the drum introduction hole and the balancer body, extended toward the laundry introduction hole from the front surface of the drum; a first flange bent toward the drum introduction hole from the first passage body to provide a space through which the liquid injected by the supplier is drawn into the first passage body; and a first passage partition wall provided in the first passage body, inserted in the rear inlet hole of each main balancer, to partition off an internal space of the first passage body into a preset number of spaces equal to the number of the balancers, and the second passage may include a second passage body provided between the first passage body and the balancer body, extended toward the laundry introduction hole from the front surface of the drum; a second flange bent toward the drum introduction hole from the second passage body to provide a space through which the liquid injected by the supplier is drawn into the second passage body; and a second passage partition wall provided in the second passage body, inserted in the front inlet hole of each main balancer, to partition off an internal space of the second passage body into a preset number of spaces equal to the number of the balancers.

The supplier may include a first outlet injecting the liquid to the first passage; a first valve controlling the first outlet to be opened and closed; a second outlet injecting the liquid to the second passage; a second valve controlling the second outlet to be opened and closed; a third outlet injecting the liquid to the sub balancer; and a third valve controlling the third outlet to be opened and closed.

Each of the main balancers may include a storage body fixed to an inner circumferential surface of the drum to provide a space where the liquid is stored; an inlet through which the liquid is drawn into the storage body; and an outlet through which the liquid stored in the storage body is exhausted outside the drum, and the drum may further include a balancer inlet hole in communication with an inlet provided in each of the main balancers; a sub balancer inlet penetrating the drum to make the sub balancer communicate with the internal space of the storage body; and a passage unit provided in the front surface of the drum to guide the liquid to the balancer inlet hole of each main balancer.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION

Preferred embodiments of the present invention will be described below in more detail with reference to the accompanying drawings. The present invention may, however, be embodied in different forms and should not be constructed as limited to the embodiments set forth herein.

Figure 1:
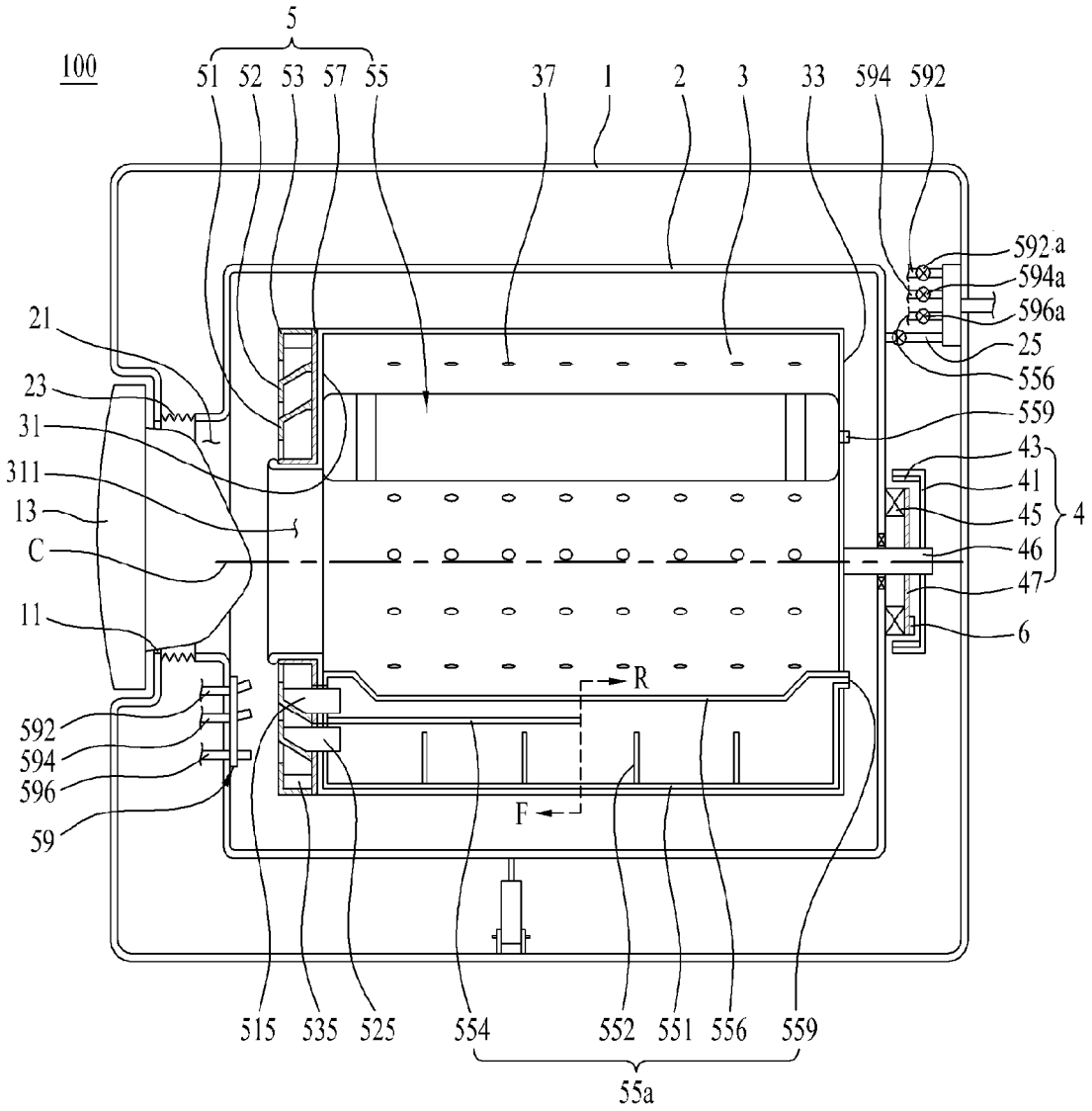
FIG. 1 is a diagram schematically illustrating a cross section of a laundry treating apparatus in accordance with one embodiment of the present disclosure.

As shown in FIG. 1, the laundry treating apparatus 100 in accordance with the present disclosure includes a cabinet 1 forming an exterior appearance, a tub 2 provided in the cabinet to hold wash water, a drum 3 rotatably provided in the tub to hold laundry, a driving unit 4 rotating the drum, and a balancing unit 5 controlling unbalance by temporarily increasing the weight of a drum area located opposite where the laundry causing unbalance of the drum is located.

FIG. 1 illustrates the laundry treating apparatus 100 performing only washing of laundry. If laundry treating apparatus 100 is a laundry treating apparatus performing both washing and drying, an air supply unit (not shown) has to be further provided in cabinet 1 to supply air to the drum.

In case of a laundry treating apparatus configured to perform only drying, tub 2 shown in FIG. 1 can be removed and an air supply unit (not shown) has to be provided to supply air to the drum.

Hereinafter, the laundry treating apparatus 100 shown in FIG. 1 will be adopted to describe embodiments of the present disclosure.

Cabinet 1 includes a laundry introduction hole 11 to load and unload laundry and a door 13 rotatably coupled to the cabinet to open and close the laundry introduction hole 11.

Tub 2 may have a hollow cylindrical shape and includes a tub introduction hole 21 in communication with the laundry introduction hole 11.

Meanwhile, a gasket 23 is provided between the tub introduction hole 21 and the laundry introduction hole 11. Gasket 23 may be a means for preventing wash water from leaking from the tub and vibration of the tub from being transferred to the cabinet.

Tub 2 is connected with a water supply source (not shown) through a tub supply pipe 25 and is provided with wash water from the water supply source when a valve opens the tub supply tube 25.

Drum 3 has a hollow-cylindrical-shaped drum body provided in the tub 2.

A drum introduction hole 311 is provided in a front surface 31 of the drum body which is in communication with laundry introduction hole 11 and tub introduction hole 21. A plurality of drum penetrating holes 37 may be provided in a circumferential surface of the drum to make an inside of the drum communicate with an inside of the tub.

Accordingly, a user may load laundry into drum 3 through laundry introduction hole 11 or unload the treated laundry from drum 3 there through. The wash water held in tub 2 may flow to the laundry held in drum 3 through drum penetrating holes 37 and the wash water held in the laundry may be exhausted to tub 2.

Diverse types of driving units 4 may be used to rotate the drum 3 in the tub 2. FIG. 1 shows a DC motor as the driving unit rotating drum 3 via a shaft 46 penetrating a rear surface of the tub 2.

Driving unit 4 shown in FIG. 1 includes a stator 45 fixed to the rear surface of tub 2, a shaft 46 fixed to a rear surface 33 of drum 3 through the rear surface of tub 2, a rotor 41 surrounding the stator with the shaft 46 fixed thereto, and a plurality of permanent magnets 43 fixed to the rotor 41 to rotate the rotor 41, using a magnetic field supplied by the stator 45.

The permanent magnets 43 may be fixedly arranged in an inner circumferential surface of rotor 41, spaced apart a preset distance from each other. Stator 45 may be insulated by an insulator 47 surrounding the stator 45.

Insulator 47 may include a sensing unit 6 (i.e., a Hall sensor) sensing a rotation speed, direction, and angle of the rotor based on a magnetic force of the permanent magnets 43.

Balancing unit 5 may be means for damping unbalance of drum 3 by temporarily increasing the weight of a drum area symmetrical to a drum area having laundry causing the unbalance with respect to a rotational center (C) of the drum 3.

Balancing unit 5 may include at least three main balancers 55 fixed to the drum 3, spaced apart a preset distance from each other, a supplier 59 provided in the tub 3 or the gasket 23, a passage unit 51, 52, and 57 provided in a front surface 31 or rear surface 33 of the drum body to guide liquid supplied by the supplier 59 to the main balancers 55, and a sub balancer 53 provided in the front surface 31 or the rear surface 33 of the drum to provide a passage (i.e., a circulation passage) to pass the liquid supplied by the supplier 59 there through.

The number of main balancers 55 may be variable, if they can be spaced apart a preset distance in the circumferential surface of the drum at a preset angle from each other. Hereinafter, three main balancers 55*a*, 55*b*, and 55*c* will be described for description sake.

Figure 2:
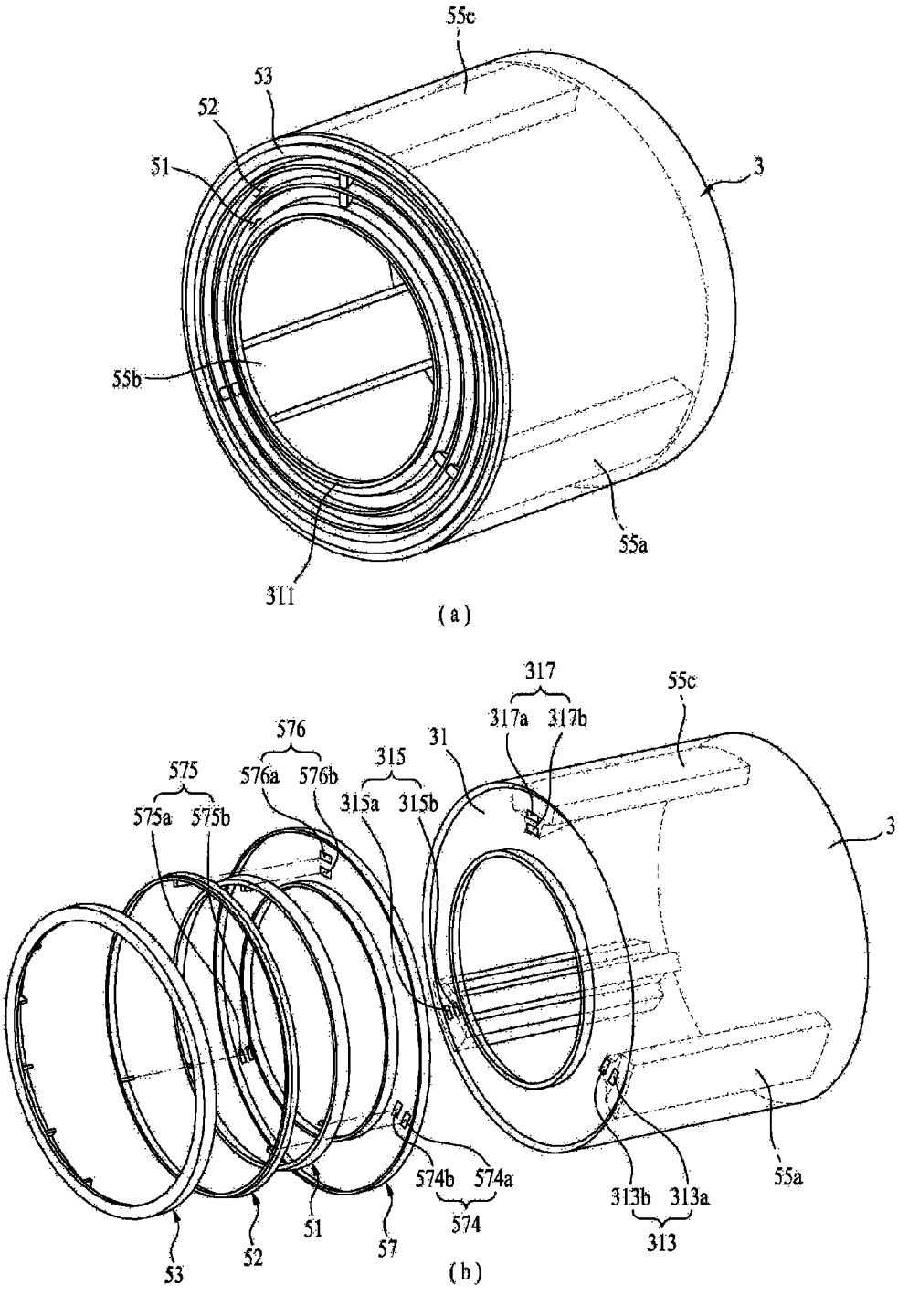
FIGS. 2 and 8 are diagrams illustrating a coupling structure between a drum and a balancing unit provided in the laundry treating apparatus in accordance with the embodiment of the present disclosure.

As shown in FIG. 2, the main balancer 55 may be fixedly provided in an outer circumferential surface of drum 3 or it may be projected from an inner circumferential surface of drum 3 toward a rotation axis (C) of the drum.

When projected from the inner circumferential surface of drum 3, the main balancer 55 may be means not only for easing the unbalance but also for agitating the laundry held in the drum during the rotation of the drum.

For that, each of the main balancers 55*a*, 55*b*, and 55*c* has to exhaust the liquid stored therein outside the drum 3 based on a rotation angle and speed of the drum 3, respectively. The main balancer having a structure which will be described hereinafter may be one example of the main balancers.

When three main balancers 55*a*, 55*b* and 55*c* are provided in the drum 3, the three main balancers are fixed to the drum 3, spaced apart at 120 degree intervals from each other with respect to the rotation center of the drum 3.

In the front surface 31 of drum 3 may be provided a first balancer inlet hole 313 in communication with the first balancer 55*a*, a second balancer inlet hole 315 in communication with the second balancer 55*b*, and a third balancer inlet hole 317 in communication with the third balancer 55*c*.

The first balancer inlet hole 313 may consist of a front inlet hole 313*a* penetrating the front surface 31 of the drum and a rear inlet hole 313*b*. The second balancer inlet hole 315 and the third balancer inlet hole 317 may consist of front inlet holes 315*a* and 317*a* and rear inlet holes 315*b* and 317*b*, respectively.

Figure 3:
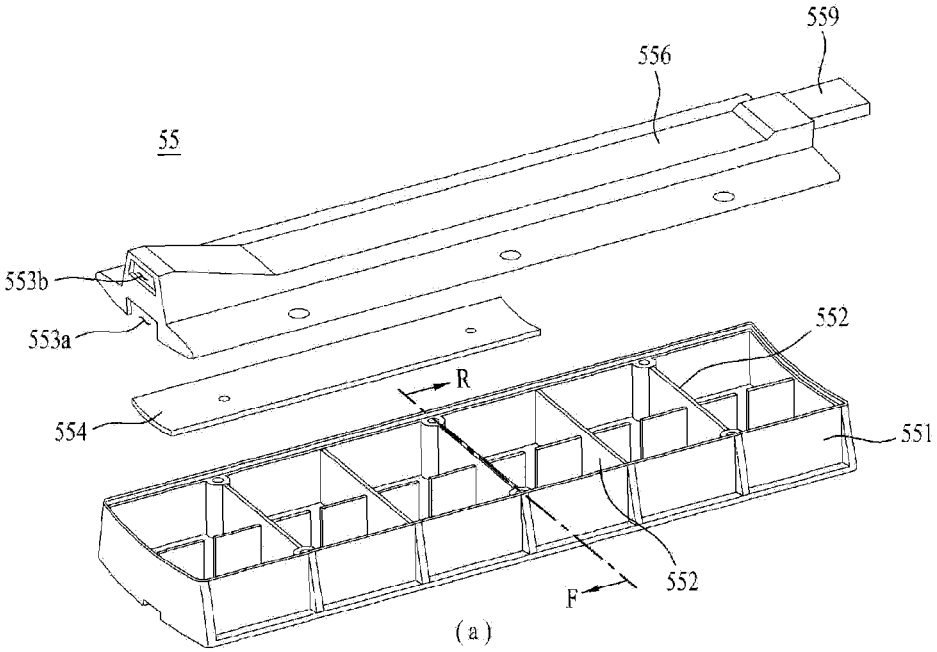
FIG. 3 is a diagram illustrating a main balancer provided in the laundry treating apparatus in accordance with the embodiment of the present disclosure.
Figure 3:
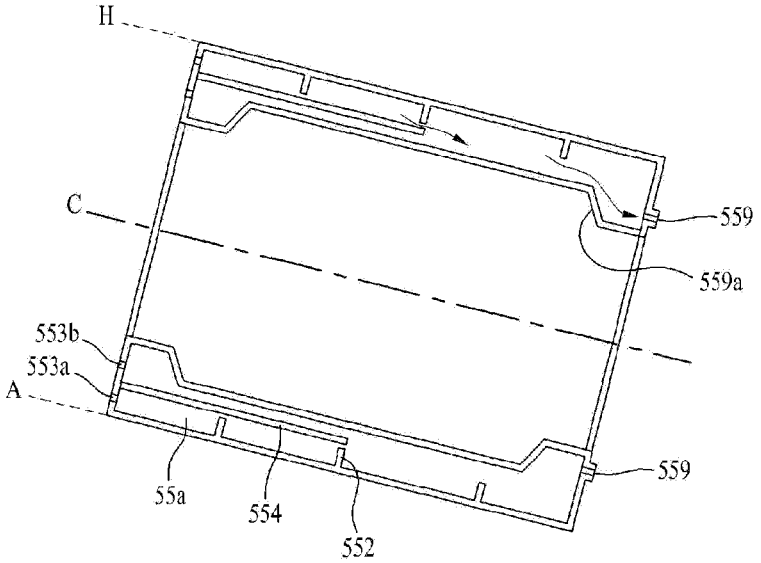

As shown in FIG. 3, each of the main balancers 55 may consist of a storage body 551 fixed to an inner circumferential surface of the drum 3 to define a space for storing the liquid, a cover 556 defining a top surface of the storage body and an outlet 559 exhausting the liquid stored in the storage body 551 outside the drum 3.

Storage body 551 is partitioned off into a front space (F) formed toward the rear surface 33 from the front surface 31 of the drum 3 and a rear space (R) formed toward the front surface from the rear surface 33 of the drum 3 by a storage partition wall 552.

The reason why the inner space of the storage body 551 is partitioned off into front space (F) and rear space (R) is to improve not only a drum diameter direction unbalance but also a longitudinal direction unbalance (in case the laundry is congregated on the front surface or the rear surface of the drum), of which detailed description will be made below.

Storage partition wall 552 may be projected from a bottom surface of the storage body 551, but not connected to cover 556, such that the liquid stored in the front space (F)

can flow to the outlet 559 via the rear space (R) when upper and lower positions of the main balancer 55 are reversed by the rotation of the drum.

When storage partition wall 552 is long enough to be connected to cover 556, a partition wall communication hole (not shown) has to be provided in the storage partition wall 552 to make the front space (F) and the rear space (R) communicate with each other.

Meanwhile, a first inlet 553*a* and a second inlet 553*b* in communication with the front space (F) may be provided at the storage body 551 or at the cover 556. A guide passage 554 is coupled to the second inlet 553*b* to guide the liquid to rear space (R).

In this instance, the first inlet 553*a* provided in the first balancer 55*a* is in communication with a front inlet hole 313*a* of the first balancer inlet hole 313 and the second inlet 553*b* is in communication with the rear inlet hole 313*b*.

The first and second inlets provided in the second balancer 55*b* are in communication with the front inlet hole 315*a* and the rear inlet hole 315*b* provided in the second balancer inlet hole 315, respectively. The first and second inlets provided in the third balancer 55*c* are in communication with the front inlet hole 317*a* and the rear inlet hole 317*b* provided in the third balancer inlet hole 317.

Guide passage 554 may guide the liquid drawn via the first inlet 553*a* to the rear space (R).

When the guide passage 554 is connected to the second inlet 553*b*, the highest water level in the front space (F) (the quantity of the liquid storable in the front space) is lowered by the position of the first inlet 553*a*. When the guide passage 554 is connected to the first inlet 553*a*, the highest water level of the front space (F) may be prevented from being lowered. In this instance, the guide passage 554 may be bent at the first inlet 553*a* toward cover 556 (i.e., inclinedly extended to a height so as not to interfere in the storage partition wall 552) and extended toward the rear space (F) after that.

Outlet 559 is provided in the top surface of the cover to exhaust the liquid stored in the storage body 551 to outside the drum 3. Outlet 559 penetrates the rear surface 33 of the drum 3 and communicates the inner space of the storage body 551 with the outside of the drum 3.

As shown in FIG. 3(*b*), the liquid stored in the main balancers 55*a*, 55*b*, and 55*c* is exhausted outside the drum 3 via the outlet 559, while the main balancer 55 is passing near the highest point (H) of a drum rotation locus.

When an outlet guider 559*a* inclined toward the outlet 559 is provided in cover 556, the liquid stored in storage body 551 can be exhausted rapidly.

Moreover, when drum 3 is tilted a preset angle with respect to a bottom surface the cabinet 1 supports, the exhaustion of the liquid stored in the storage body 551 can be performed even more rapidly.

The main balancer 55 having the structure mentioned above may be provided with the liquid via the passage unit 51, 52, and 57 provided at one or both of the front and rear surfaces of the drum 3.

FIG. 2 illustrates one example of the passage unit provided in the front surface 31 of the drum 3. The passage unit may consist of a base 57 fixed to the front surface 31 of the drum 3, a first passage 51 provided in the base 57 to guide the liquid to front inlet holes 313*a*, 315*a*, and 317*a* or the rear inlet hole 313*b*, 315*b*, and 317*b*, and a second passage 52 provided in the base 57 to guide the liquid to the other inlet holes.

The function of base 57 may be performed by front surface 31 of drum 3. Accordingly, base 57 can be omitted. Hereinafter, the passage unit including base 57 will be described.

Figure 4:
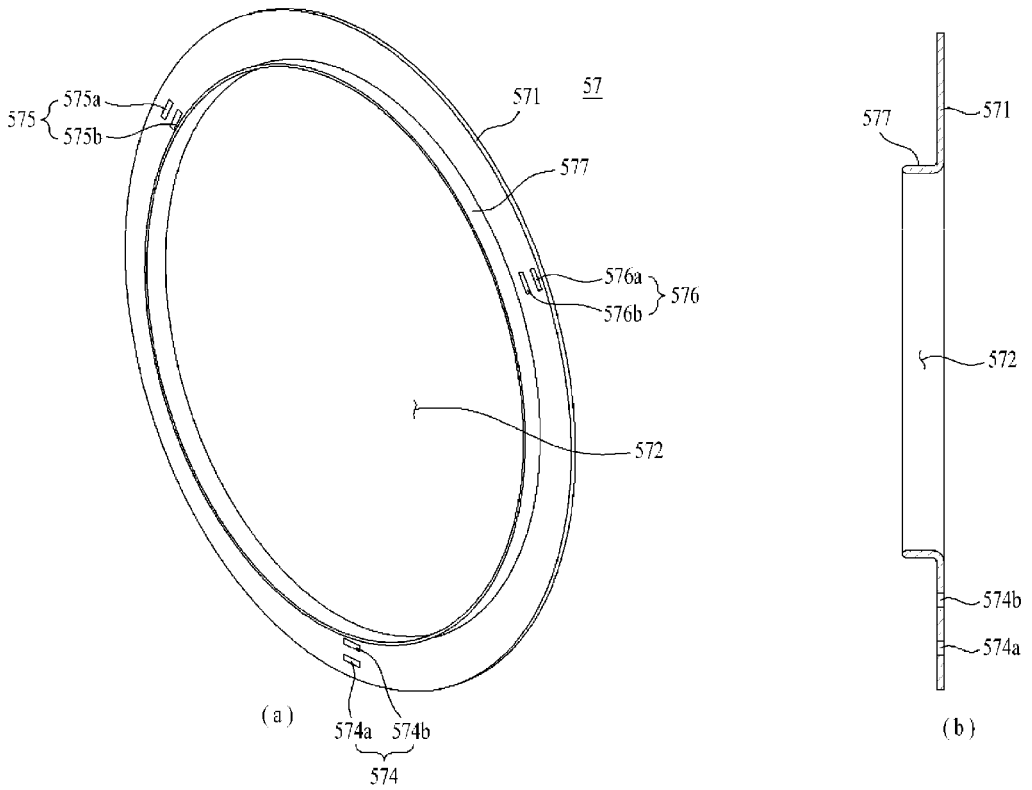
FIGS. 4 through 6 are diagrams illustrating a passage unit provided in the laundry treating apparatus in accordance with the embodiment of the present disclosure.

As shown in FIG. 4, base 57 may include a base body 571 coupled to the front surface 31 of the drum 3 and a base flange 577 extended from the base body 571 toward the laundry introduction hole 11.

Base body 571 may be a ring-shaped plate having a base penetrating hole 572 formed a center thereof.

In case drum introduction hole 311 is projected from front surface 31 of the drum 3 toward laundry introduction hole 11, base flange 577 may accommodate an outer circumferential surface of the drum introduction hole 311.

Base body 571 may be provided with a first communication hole 574 connected to the first balancer outlet hole 313, a second communication hole 575 connected to the second balancer outlet hole 315, and a third communication hole 376 connected to the third balancer outlet hole 317.

First communication hole 574 is formed through base body 571 and it may include a front communication hole 574*a* and a rear communication hole 574*b* which are connected to the front outlet hole 313*a* and the front outlet hole 313*b* of the first balancer outlet hole, respectively.

Second communication hole 575 may include a front communication hole 575*a* and a rear communication hole 575*b* connected to the front outlet hole 315*a* and the rear outlet hole 315*b* of the second balancer outlet hole, respectively. Third communication hole 576 may include a front communication hole 576*a* and a rear communication hole 576*b* connected to the front outlet hole 317*a* and the rear outlet hole 317*b* of the third balancer outlet hole, respectively.

The first passage 51 in accordance with the present disclosure may be formed by a first passage body 511 fixed to the base body 571, spaced apart a preset distance from base flange 577. In case base 57 is omitted from the passage unit, the first passage 51 may be formed by the cylindrical shaped drum introduction hole 311 projected from the front surface 31 of the drum 3 and the first passage body 511.

Figure 5:
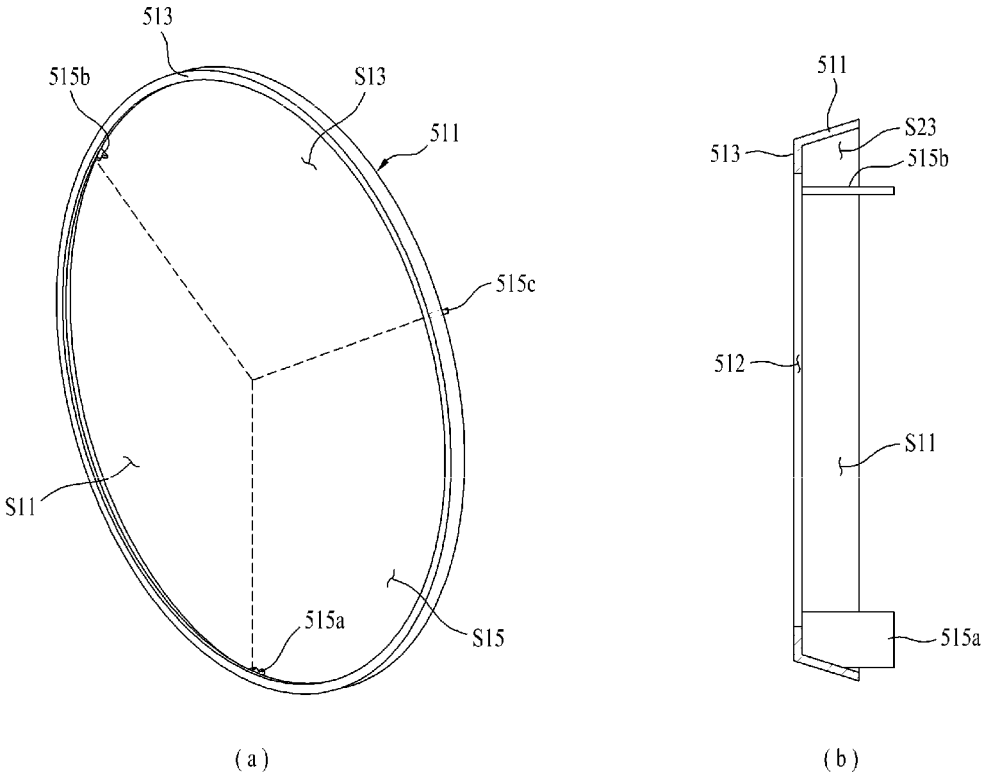

As shown in FIG. 5, the first passage body 511 may be formed in a ring shape, with a first body penetrating hole 512 accommodating the base flange 577.

In this instance, a free end of the first passage body 511 may include a first flange 513 extended toward the base flange 577 (i.e., extended toward the drum introduction hole from the first passage body).

A free end of the first flange 513 is spaced apart a preset distance from the base flange 577 and the liquid injected by the supplier 59 which will be described later may be supplied to first passage 51 through a space between the free end of the first flange 513 and the base flange 577.

The internal space of first passage 51 defined by base body 571, base flange 577, first passage body 511, and first flange 513 may be partitioned into a number of spaces equal to the number of the balancers 55 by a first passage partition wall 515*a*, 515*b*, and 515*c* provided in the first passage body 511.

Specifically, in case three balancers 55*a*, 55*b*, and 55*c* are provided in the drum, spaced apart at 120 degrees intervals with respect to the rotation center of the drum, three first passage partition walls 515*a*, 515*b*, and 515*c* are provided in first passage 51 to partition off the internal space of first passage 51 into a first space S11, a second space S13, and a third space S15.

The first passage partition walls 515*a*, 515*b*, and 515*c* are extended from the first flange 513 toward the base body 571.

The first passage partition walls 515*a*, 515*b*, and 515*c* are inserted into the rear communication holes 574*a*, 575*b*, and 576*b* provided in the base body 571, respectively.

Accordingly, first passage body 511 may allow the liquid drawn into the first passage to flow into the rear space (R) of each main balancer.

Second passage 52 in accordance with the present disclosure may be formed by the second passage body 521 fixed to the base body 571, spaced apart a preset distance from the first passage body 511.

Figure 6:
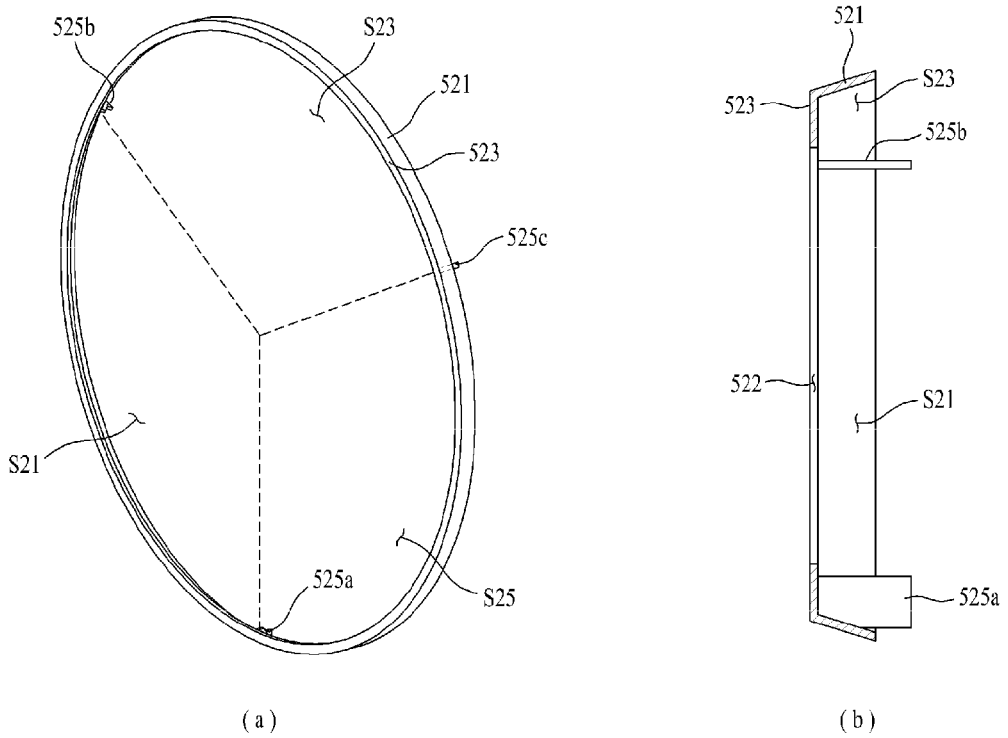

As shown in FIG. 6, second passage body 521 is ring-shaped. A second body penetrating hole 522 is provided in a center of the second passage body 521 to receive the first passage body 511. A second flange 523 extended toward the first passage body 511 (i.e., bent toward the drum laundry introduction hole) is provided in a free end of the second passage body 521.

Three second partition walls 525*a*, 525*b*, and 525*c* are provided in the second passage body 521 to partition off the internal space of the second passage 52 into a first space S21, a second space S23, and a third space S25.

Second passage partition walls 525*a*, 525*b*, and 525*c* are extended from second flange 523 toward base body 571. Second passage partition walls 525*a*, 525*b*, and 525*c* are inserted into the front communication holes 574*a*, 575*a*, and 576*a* provided in the base body 571, respectively.

Accordingly, the second passage body 521 may allow the liquid drawn into the second passage to flow into the front space (F) of each main balancer.

Sub balancer 53 in accordance with the present disclosure is a means provided in the front surface 31 of the drum 3 to provide a circulation passage of the liquid supplied by supplier 59. Sub balancer 53 has a structure configured to exhaust the liquid stored in the circulation passage outside the circulation passage based on the rotation speed of drum 3.

The liquid supplied to the circulation passage by the sub balancer 53 is rotated together with the drum, when the rotation speed of the drum is uniform. The liquid moves toward the lowest point of the drum rotation locus, when the rotation speed of the drum is decreased (i.e., when the centrifugal force acting in the liquid is decreased).

The speed of the unbalanced drum is the highest when the laundry causing the unbalance is passing the lowest point of the drum rotation locus. The speed of the unbalanced drum is the lowest, when the laundry causing the unbalance is passing the highest point of the drum rotation locus.

Accordingly, the sub balancer 53 in accordance with the present disclosure guides the liquid toward the lowest point of the drum rotation locus to damp the unbalance, when the laundry causing the unbalance is moving toward the highest point of the drum rotation locus.

The main balancer 55 in accordance with the present disclosure is provided in the drum 3 such that most of the unbalance generated in the drum can be damped. However, it takes time to supply a sufficient amount of liquid to damp the unbalance. The sub balancer 53 may be the means for damping the unbalance generated in the drum before all the required amount of the liquid is supplied to the main balancer.

Additionally, the sub balancer 53 may be a means for controlling the unbalance (i.e., laundry movement inside the drum and liquid flow inside the main balancer) not damped even with the required amount of liquid supplied to the main balancer 55.

Figure 7:
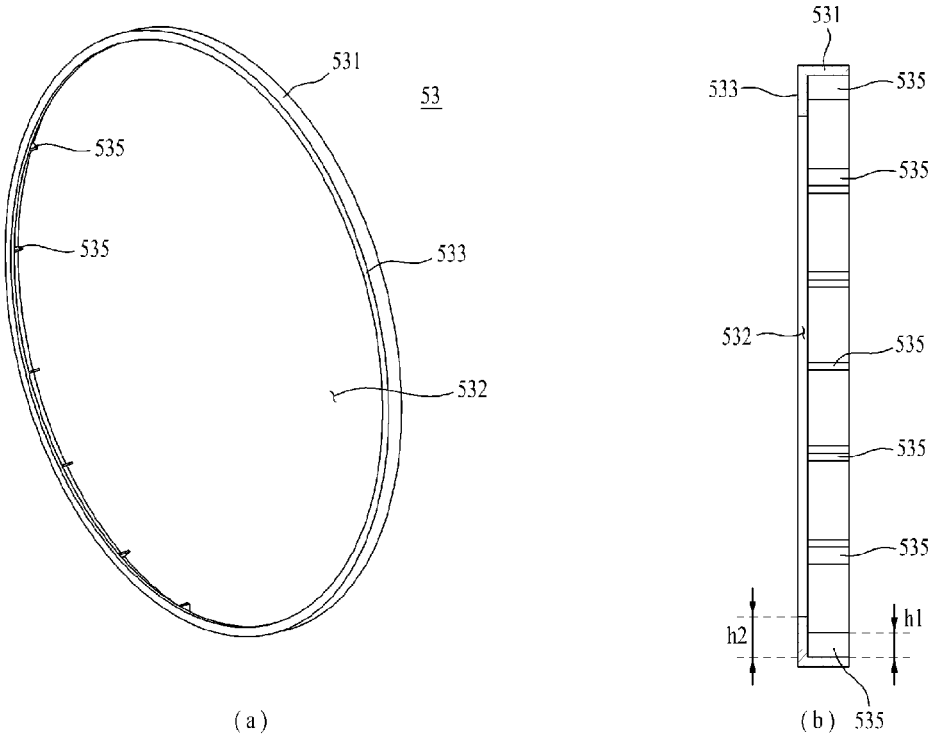
FIG. 7 is a diagram illustrating a sub balancer provided in the laundry treating apparatus in accordance with the embodiment of the present disclosure.

As shown in FIG. 7, the sub balancer 53 in accordance with the present disclosure may include a balancer body 531 fixed to the base body 571 to accommodate the second passage body 521, a body penetrating hole 532 penetrating a center of the balancer body 531 to accommodate the second passage body 521, and a balancer flange 533 extended from a free end of the balancer body 531 toward the second passage body 521 (i.e., bent toward the drum introduction hole).

A free end of the balancer flange 533 is spaced apart a preset distance from the second passage body 521 and the liquid injected by supplier 59 described later herein may be drawn into the sub balancer 53 through a space formed between the balancer flange 533 and the second passage body 521.

Meanwhile, a plurality of partition walls 535 may be further provided in the balancer body 531, projected toward the second passage body 521 (i.e., projected toward the drum introduction hole or toward the rotation center of the drum).

In this instance, a distance (h1) from balancer body 531 to a free end of balancer partition wall 535 is narrower than a distance (h2) from balancer body 531 to a free end of balancer flange 533.

Balancer partition wall 535 partitions off an internal space of the circulation passage formed by the sub balancer 53 into several spaces and it is a means for allowing the partitioned spaces to communicate with each other. Also, balancer partition wall 535 may be a means for minimizing the generation or aggravation of the unbalance caused by the flow of the liquid supplied to the circulation passage.

Once all the required amount of the liquid is supplied to the main balancer 55, there is not so much difference between the rotation speed of the drum when the laundry is passing the highest drum rotation locus and the rotation speed when passing the lowest point of the drum rotation locus even with the unbalance generated by the movement of the laundry or the liquid flow in the main balancer.

When the liquid inside the sub balancer is flowing along the circulation passage even with small variation of the drum rotation speed after the required amount of the liquid is supplied to the main balancers 55, there is a risk of the liquid inside sub balancer 53 aggravating the unbalance of the drum.

Balancer partition wall 535 mentioned above may delay the flow of the liquid inside the circulation passage as the means for preventing such disadvantages, when the difference between the rotation speed of the drum when the laundry passing the highest point of the drum rotation locus and the rotation speed when it is passing the lowest point of the drum rotation locus is below a preset value.

Figure 8:
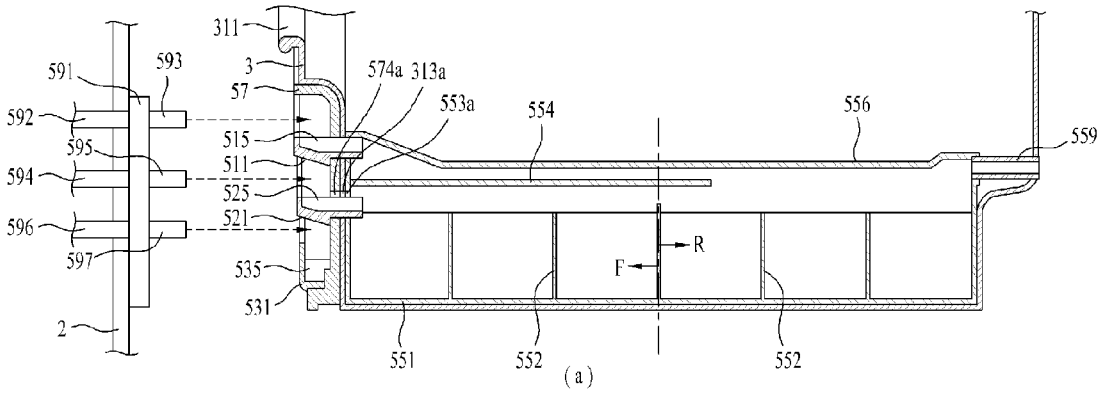
Figure 8:
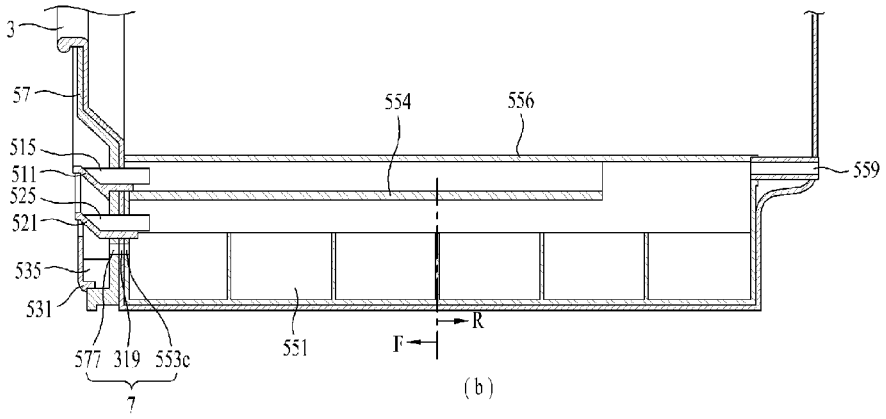

Meanwhile, first passage body 511, second passage body 521, and sub balancer 53 in accordance with the present disclosure may have the structure shown in FIG. 8(*b*).

That is, first passage body 511 is inclined toward the base flange 577 from the base body 571. Second passage body 521 is inclined toward the first passage body 511 from the base body 571. Second passage body 521 may be spaced apart a preset distance from the first passage body 511.

When the first passage body 511 and the second passage body 521 are inclined toward the base flange 577 (or the drum introduction hole 311), a liquid storage space may be formed even without flanges 513 and 523 provided in the first passage body 511 and the second passage body 521.

In addition, when first passage body 511 and second passage body 521 have the structure shown in FIG. 8(*b*), a preset course (e.g., a washing course, a rinsing course, and a spinning course) is completed and the rotation speed of the drum is decreased. When the drum 3 is passing the highest point of the rotation locus, the inclined surface of the second passage body 521 may effectively exhaust the liquid stored in the sub balancer 53 from the balancer body 531.

Meanwhile, with the structure shown in FIG. 8(*a*), the inclined surface is provided in one surface of the second passage body 521 toward the balancer body 531. In this instance, the same effect as FIG. 8(*b*) may be realized.

Main balancer 55 and sub balancer 53 mentioned above may be provided with the liquid by supplier 59. Supplier 59 may be provided in any portions in the cabinet allowing, so long as its position allows injecting of liquid to the first passage 51, the second passage 52, and the sub balancer 53.

FIG. 8(*a*) illustrates one embodiment where the supplier 59 is fixed to tub 2.

In this configuration, supplier 59 may consist of a body 591 fixed to the tub 2, a first outlet 593 provided in the body 591 to supply the liquid to the first passage 51, a second outlet 595 to supply the liquid to the second passage 52, and a third outlet 597 to supply the liquid to the sub balancer 53.

First outlet 593 is connected to the water supply source via a first supply pipe 592 and the second outlet 595 is connected to the water supply source via a second supply pipe 594. The third outlet 597 is connected to the water supply source via a third supply pipe 596.

The supply pipes 592, 594, and 596 are opened and closed by a first valve 592*a*, a second valve 594*a*, and a third valve 596*a*, respectively. The control unit (not shown) may control the liquid to be supplied to the first passage 51, the second passage 52, and the sub balancer 53 (i.e., the circulation passage) and control the liquid to be supplied only to the necessary passage.

The supplier 59 having the structure mentioned above may be provided in a position corresponding to the sensing unit 6.

Figure 9:
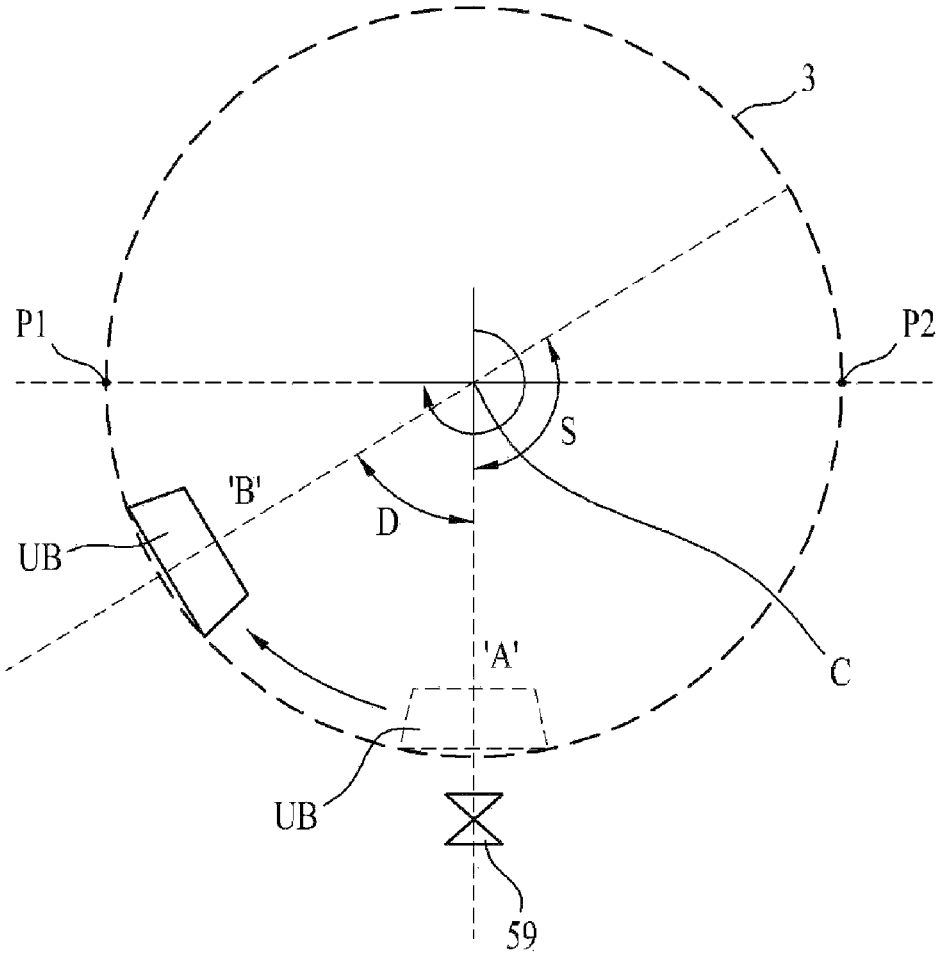
FIGS. 9 through 11 are diagrams illustrating an unbalance damping process.

For example, as shown in FIG. 9, the sensing unit 6 (see FIG. 1) is provided to sense a magnetic force of a permanent magnet passing the lowest point of a rotation locus of rotor 41 and the supplier 59 is provided to supply the liquid toward the lowest point of a rotation locus of the drum 3.

When the drum 3 is rotated a preset angle right after the laundry (UB) causing the unbalance passes the supplier 59 (point 'A'), the control unit (not shown) in accordance with the present disclosure controls the liquid to be supplied to a specific balancer 55*a*, 55*b*, and 55*c* for a preset time period (while the drum is rotated a preset angle) to damp the unbalance.

Accordingly, when sensing unit 6 and supplier 59 are provided on the same plane passing the rotation axis (C) of the drum, the control unit may determine that the laundry causing the unbalance passed the lowest point of the drum 3 rotation locus based on a signal transmitted from the sensing unit 6 such that the control mentioned above can be easy effectively.

Moreover, only when the position of supplier 59 is corresponding to the position of the sensing unit 6, supplier 59 may inject the liquid toward points (P1 and P2) of the drum rotation locus where a line passing the rotation axis (C) of the drum 3, in parallel to the bottom surface of cabinet 1, meets the drum rotation locus.

The reason why the supplier injects the points (P1 and P2) is to minimize a risk of failing to supply the liquid injected from the outlets 593, 595, and 597 to the first passage 51, the second passage 52, and the sub balancer 53, in case there is deflection of the drum 3 toward the bottom of the cabinet 1 which is generated by the weight of the laundry.

Hereinafter, referring to FIGS. 9 through 11, a process of controlling the unbalance will be described.

First of all, a process of controlling the unbalance will be described, in case the laundry causing the unbalance is uniformly distributed along a longitudinal direction of the drum.

During the rotation of the drum, the control unit (not shown) measures the rotation speed of the drum based on the data provided by sensing unit 6 and determines which drum area the laundry (UB) causing the unbalance is located based on the measured rotation speed of the drum.

Hence, the control unit determines whether the laundry (UB) causing the unbalance passed the lowest point (A) of the drum rotation locus at which the supplier 59 is located. When the laundry (UB) causing the unbalance passes the supplier 59 based on the result of the determination, the control unit determines whether the drum is rotated as far as a preset angle (D).

Once the drum is rotated a standby angle (D), the control unit opens the valves 592*a*, 594*a*, and 596*a* until the drum 3 is rotated to a preset supply angle (S) and supplies the liquid to the first passage 51, the second passage 52, and the sub balancer 53.

In case three balancers 55 are supplied in the circumferential surface of the drum 3 (i.e., in case the balancers are spaced apart at 120 degrees intervals), the standby angle (D) is set to 60 degrees and the supply angle (S) is set to 120 degrees.

Meanwhile, when the balancers 55 are spaced apart at 90 degrees intervals along the circumferential surface of the drum from each other, the standby angle (D) and the supply angle (S) may be set to 90 degrees, respectively. When the balancers 55 are spaced apart at 60 degrees intervals along the circumferential surface of the drum from each other, the standby angle (D) and the supply angle (S) may be set to 120 degrees and 60 degrees, respectively.

The values mentioned above may be variable by adjusting the amount of the liquid exhausted from the first outlet 597 and the second outlet 599.

Figure 10:
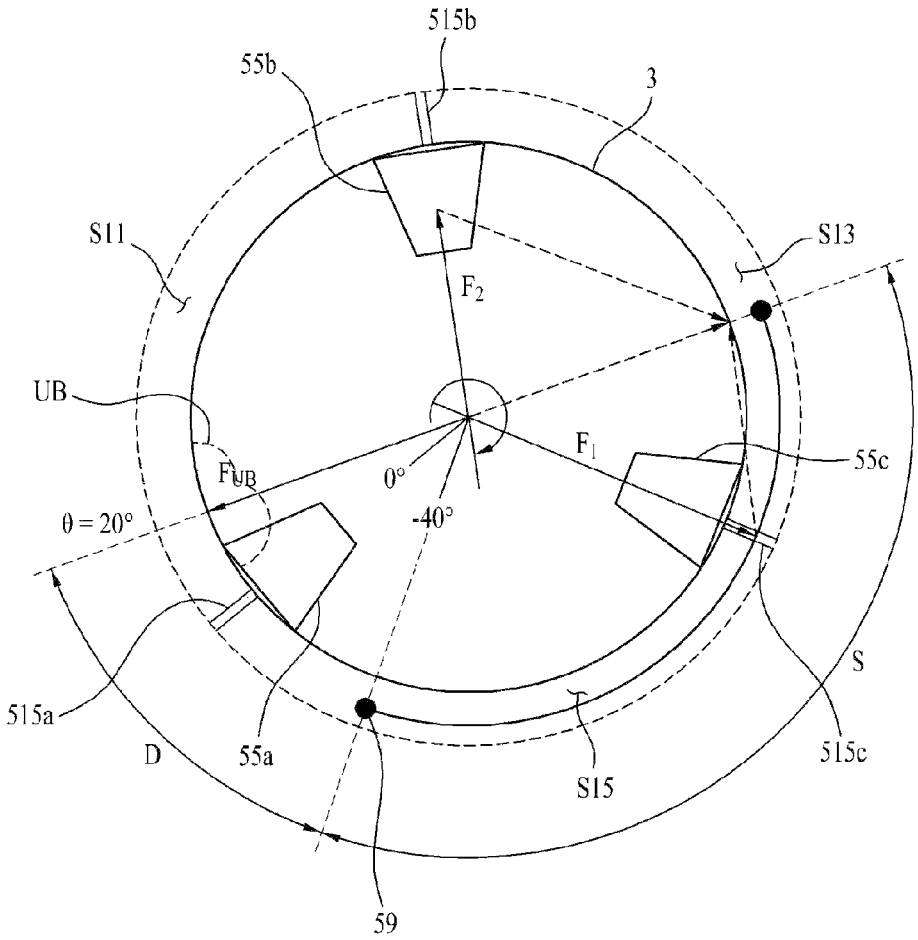

In case the laundry is concentrated on an area between the first balancer 55*a* and the second balancer 55*b* as shown in FIG. 10, the liquid has to be supplied to each of the second balancer 55*b* and the third balancer 55*c* and the force (F ub) causing the unbalance may be then reduced.

Accordingly, the control unit controls first outlet 593, second outlet 595, and third outlet 597 to inject the liquid until the drum rotation angle reaches the supply angle (120 degrees) from the standby angle (60 degrees) at which the drum is rotated once the laundry (UB) passes supplier 59.

In this instance, the liquid injected from first outlet 593 may be supplied to third space S15 and second space S13 provided in first passage 51. Although not shown in the drawing, the liquid injected from the second outlet 595 may be supplied to the third space (S25) and the second space (S23) provided in the second passage 52.

Figure 11:
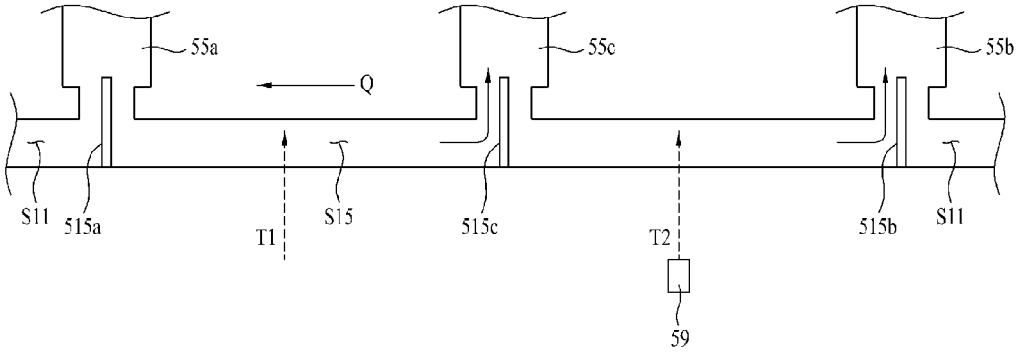

As shown in FIG. 11, the liquid injected into the third space (S15) of first passage 51 flows in the reverse direction of the drum rotation direction (Q) in the first passage 51 and flows into the rear space (R) of the third balancer 55*c* along the guide of the partition wall 515*c*. The liquid injected into the second space (S13 of the first passage flows into the rear space (F) of the second balancer 55*b* along the guide of the partition wall 515*b*.

Although not shown in the drawing, the liquid injected into the third space and the second space of the second passage also flows into the front space (F) of the third balancer 55*c* and the front space (F) of the second balancer 55*b* in accordance with the principle mentioned above.

The liquid injected by supplier 59 while the drum is rotated 80 degrees is stored in the third balancer 55*c*. The liquid injected by supplier 59 while the drum is rotated 40 degrees is stored in the second balancer 55*b*. Accordingly, the sum of the force (F1) generated by the liquid stored in third balancer 55*c* and the force (F2, F2<F1) generated by the liquid stored in the second balancer 55*b* may dampen the force (Fub) generated by the laundry.

Accordingly, the laundry treating apparatus provided with the above-noted features may solve the problem of the unbalance of the drum actively, the liquid being supplied to the means for agitating the laundry held in the drum.

Meanwhile, while the preset amount of the liquid is supplied to the third balancer 55*c* and the second balancer 55*b*, the liquid supplied to the sub balancer 53 flows toward the highest point of the drum rotation locus every time the laundry moves toward the drum rotation locus, to diminish the unbalance.

After the preset amount of liquid is supplied to the third balancer 55*c* and the second balancer 55*b*, the sub balancer 53 may control the unbalance generated by the flow of the liquid stored in each of the main balancers and the flow of the laundry held in the drum.

The liquid supplied to third balancer 55*c*, second balancer 55*b*, and sub balancer 53 may be stored in the balancers continuously (because of the centrifugal force generated by the rotation of the drum), while the drum maintains a preset rotation speed.

However, when the rotation speed of the drum is lowered to end an ongoing course, the liquid stored in the third balancer 55*c* and the second balancer 55*b* is exhausted outside the drum 3 via the outlet 559 during the rotation of the drum toward the highest point of the rotation locus. The liquid stored in the sub balancer 53 is exhausted from the sub balancer via the space between the balancer flange 533 and the second passage body 521.

Meanwhile, in case the laundry is concentrated on only one of the front and rear surfaces 31 and 33 of the drum 3, a method which will be described hereinafter may dampen the unbalance.

When the laundry is concentrated on the front surface 31 of the drum, the control unit may supply the liquid only to the rear space (R) of each main balancer 55*a*, 55*b*, and 55*c* and thus dampen the unbalance of the drum. In this method, the determination on which balancer is provided with the liquid and the method of supplying the liquid to the sub balancer is equal to the determination and the method mentioned above, and detailed description thereof will be omitted accordingly.

The sub balancer 53 is provided in the front surface 31 of the drum 3. When the laundry is concentrated on the front surface 31 of the drum, sub balancer 53 may not be provided with the liquid.

Meanwhile, in case the laundry is concentrated on the rear surface 33 of the drum 3, the control unit may supply the liquid only to the front space (F) of each main balancer via the second passage 52 and thus dampen the unbalance of the drum.

Sub balancer 53 mentioned above is structured to be provided with the liquid by supplier 59. Alternatively, sub balancer 53 may be structured to be provided with the liquid by each of the main balancers.

In other words, as shown in FIG. 8(*b*), when a sub balancer supplier 7 is provided to make an internal space of each main balancer (one space of F and R) communicate with an internal space of the sub balancer 53, the sub balancer 53 may be provided with the liquid even without the third outlet 597 provided in the supplier 59.

Sub balancer supplier 7 may consist of a pipe (not shown) penetrating each of the main balancers 55, the front surface 31, and the base body 571.

Alternatively, sub balancer supplier 7 may consist of a sub balancer outlet 533*c* provided in the main balancer, a sub balancer inlet hole 319 in communication with the sub balancer outlet 553*c* through the front surface of the drum 3, and a fourth communication hole 577 penetrating the base body to communicate the sub balancer 53 with the sub balancer inlet hole 319.

Figure 12:
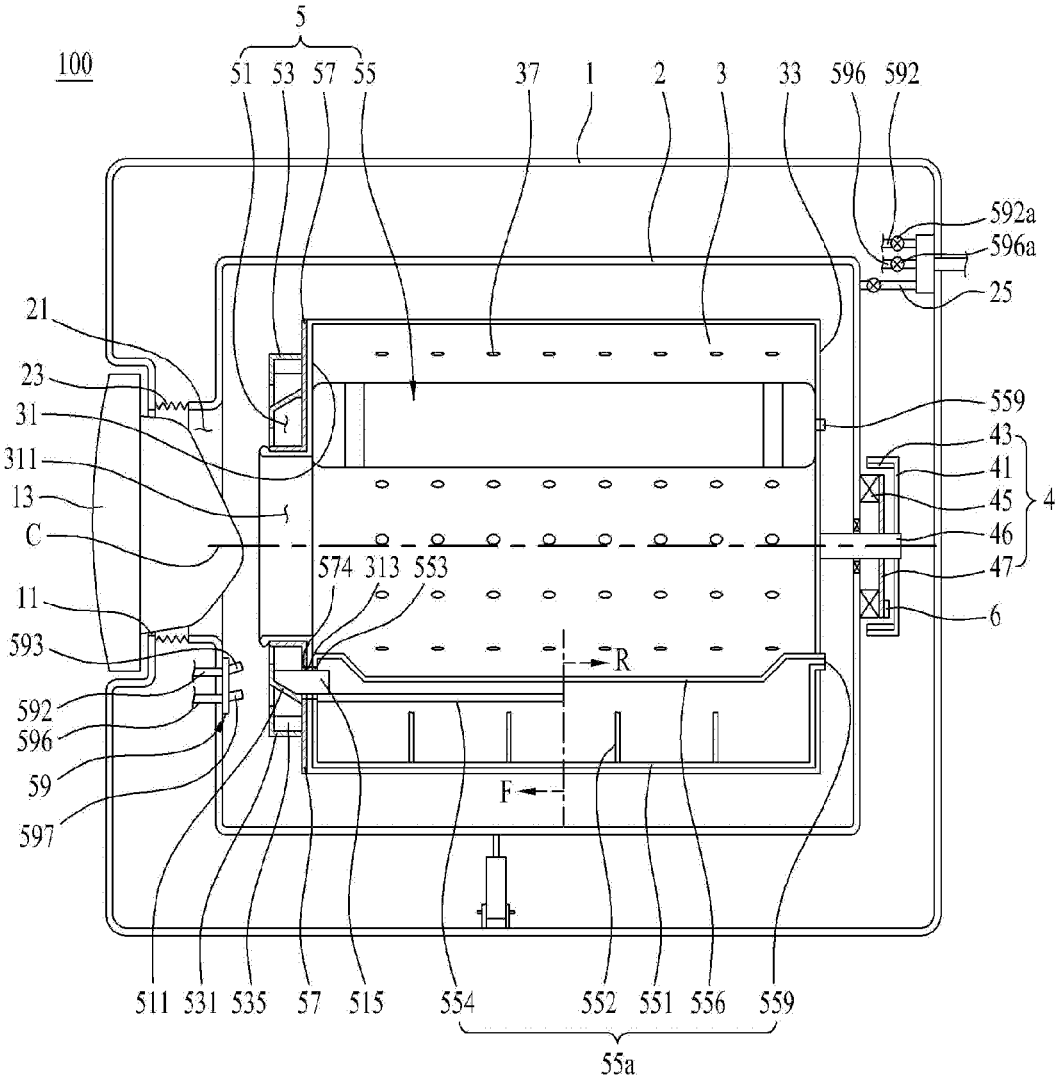
FIG. 12 is a diagram illustrating a laundry treating apparatus in accordance with another embodiment of the present disclosure.

FIG. 12 illustrates another embodiment of the laundry treating apparatus in accordance with the present disclosure. In this embodiment, second passage 52 may not be provided, which makes this embodiment different from the embodiment of FIG. 1. Accordingly, this embodiment may control only the unbalance generated in a plane parallel to a direction toward a diameter of the drum.

A balancing unit 5 in accordance with this embodiment may consist of a main balancer 55 provided in the drum 3, a base 57 provided in a front surface 31 of the drum 3, a first passage 51 fixed to the base to supply the liquid to each of the main balancers 55, a sub balancer 53 fixed to the base, and a supplier 59 supplying the liquid to the first passage and the sub balancer.

The structure of base 57 and the structure of first passage 51 are equivalent to the structures disclosed in the embodiment shown in FIGS. 4 and 5.

When a first passage body 511 provided in the first passage 51 is inclined toward a base flange 577, fixed to the base body 571, the first flange 513 may be omitted (see FIG. 8(*b*)).

When the first passage body 511 is inclined toward the base flange 577 or the first passage body 511 has an inclined surface toward the sub balancer 53, the liquid stored in the sub balancer 53 may be exhausted outside the sub balancer 53 easily and effectively.

In this embodiment, the main balancers 55 provided in the drum may require only one inlet for drawing the liquid supplied via the first passage into storage body 551. Accordingly, three inlet holes 313 corresponding to the inlets provided in the main balancers are provided. Three communication holes 574 corresponding to the inlets 553 are provided in the base body 571.

A guide passage 554 provided in each of the main balancers may be extended from the inlet 553 to a center of the storage body 551 to flow the liquid drawn through inlet 553 toward an edge portion of storage body 551 from a center of the storage body 551.

The unbalance generated by the liquid in case the liquid is supplied via a front space (F) of the storage body 551 should be prevented.

Even in this embodiment, sub balancer 53 may have the structure shown in FIG. 7.

Specifically, sub balancer 53 may consist of a balancer body 531 fixed to the base body 571, spaced apart a preset distance from the first passage body 511, a body penetrating hole 533 penetrating the balancer body 531 to provide a space where first passage body 511 is accommodated, a balancer flange 533 extended toward the first passage body 511 from balancer body 531, and a plurality of balancer partition walls 535 provided in the balancer body 531 to partition off an internal space (i.e., a circulation passage) of the sub balancer into a plurality of spaces.

Meanwhile, supplier 59 in accordance with this embodiment requires only two outlets 593 and 597 for supplying the liquid to the first passage and the sub balancer and two supply pipes 592 and 596.

When the sub balancer supplier 7 shown in FIG. 8(*b*) is provided, even the outlet 597 for supply the liquid to the sub balancer, supply pipe 596, and valve 596*a* may be omitted.

As mentioned above, embodiments of the present invention may have an effect of providing the laundry treating apparatus with active improvement of the unbalanced rotation (i.e., the unbalance) of the drum holding the laundry.

Furthermore, embodiments of the present invention may have an effect of providing the laundry treating apparatus with features that may improve the unbalance of the drum, using the liquid supplied to the means for agitating the laundry loaded in the drum.

Still further, embodiments of the present invention may have an effect of providing the laundry treating apparatus with features that may improve not only a diameter direction plane unbalance of the drum but also a longitudinal direction plane unbalance of the drum.

Still further, embodiments of the present invention may have an effect of providing the laundry treating apparatus with features that may improve the unbalance of the drum by providing the passage of the liquid along the same or reverse of the drum rotation direction during the rotation of the drum.

What is claimed is:

1. A laundry treating apparatus comprising:

a cabinet including a laundry introduction hole formed therein to introduce laundry;

a drum rotatably provided in the cabinet, the drum comprising a drum introduction hole, formed in a front surface thereof, in communication with the laundry introduction hole;

at least three main balancers provided in the drum defining a space where liquid is stored, wherein the main balancers are spaced apart from each other at preset angle intervals with respect to a rotation axis of the drum;

a sub balancer provided at the drum to provide a circulation passage of the liquid, the circulation passage having an annular shape, the sub balancer increasing load of the drum locally by flowing the liquid stored in the circulation passage to the lowest point of a drum rotation locus based on a rotation speed of the drum; and a supplier selectively supplying the liquid to each of the main balancers and the sub balancer, wherein the sub balancer exhausts the liquid stored in the circulation passage outside the circulation passage based on the rotation speed of the drum, and wherein the circulation passage does not communicate with the main balancers.

2. The laundry treating apparatus of claim 1, wherein each of the main balancers exhausts the liquid stored therein outside the drum based on a rotation angle of the drum and the rotation speed of the drum.

3. The laundry treating apparatus of claim 1, wherein the sub balancer comprises:

a balancer body extended toward the laundry introduction hole from the front surface of the drum, with a diameter larger than a diameter of the drum introduction hole; and a balancer flange bent toward the drum introduction hole from the balancer body to provide a space through which the liquid injected by the supplier is drawn into the balancer body.

4. The laundry treating apparatus of claim 3, wherein the sub balancer further comprises:

a plurality of balancer partition walls projected toward the drum introduction hole from the balancer body.

5. The laundry treating apparatus of claim 4, wherein a distance from the balancer body to a free end of the balancer partition wall is smaller than a distance from the balancer body to a free end of the balancer flange.

6. The laundry treating apparatus of claim 3, wherein each of the main balancers is projected toward a rotation axis of the drum from an inner circumferential surface of the drum.

7. The laundry treating apparatus of claim 6, wherein each of the main balancer comprises:

a storage body fixed to the inner circumferential surface of the drum to define a space where the liquid is stored;

an inlet through which the liquid is drawn into the storage body; and an outlet through which the liquid stored in the storage body is exhausted outside the drum, and wherein the drum further comprises:

a balancer inlet hole in communication with the inlet provided in each of the main balancers; and a passage unit provided in the front surface of the drum to guide the liquid supplied by the supplier to the balancer inlet hole.

8. The laundry treating apparatus of claim 7, wherein each of the main balancers further comprises:

a guide passage connected to the inlet to guide the liquid drawn through the inlet toward an edge of the storage body from a center of the storage body.

9. The laundry treating apparatus of claim 7, wherein the passage unit comprises:

a first passage body provided between the drum introduction hole and the balancer body, extended toward the laundry introduction hole from the front surface of the drum;

a first flange bent toward the drum introduction hole from the first passage body to provide a space through which the liquid injected by the supplier is drawn into the first passage body; and a first passage partition wall provided in the first passage body, inserted in the balancer inlet hole provided in each of the main balancer, to partition off an internal space of the first passage body into a preset number of spaces equal to the number of the main balancers.

10. The laundry treating apparatus of claim 9, wherein the first passage body further comprises:

an inclined surface guiding the liquid stored in the sub balancer to be exhausted outside.

11. The laundry treating apparatus of claim 7, wherein the passage unit comprises:

a first passage body provided between the drum introduction hole and the balancer body, inclined toward the laundry introduction hole from the front surface of the drum; and a first passage partition wall provided in the first passage body, inserted in the balancer inlet hole provided in each of the main balancers, to partition off an internal space of the first passage body into a preset number of spaces equal to the number of the main balancers.

12. The laundry treating apparatus of claim 6, wherein each of the main balancers comprises:

a storage body fixed to an inner circumferential surface of the drum, the storage body comprising a front space toward the front surface of the drum and a rear space toward a rear surface of the drum;

a first inlet and a second inlet through which the liquid is drawn into the front space;

a guide passage guiding the liquid drawn through the second inlet to the rear space; and an outlet through which the liquid stored in the storage body is exhausted outside the drum, and wherein the drum further comprises:

a front inlet hole in communication with the first inlet;

a rear inlet hole in communication with the second inlet; and a passage unit provided in the front surface of the drum, the passage unit comprising a first passage guiding the liquid supplied by the supplier to one of the front and rear inlet holes and a second passage guiding the liquid supplied by the supplier to the other one of the front and rear inlet holes.

13. The laundry treating apparatus of claim 12, wherein the first passage comprises:

a first passage body provided between the drum introduction hole and the balancer body, extended toward the laundry introduction hole from the front surface of the drum;

a first flange bent toward the drum introduction hole from the first passage body to provide a space through which the liquid injected by the supplier is drawn into the first passage body; and a first passage partition wall provided in the first passage body, inserted in the rear inlet hole of each main balancer, to partition off an internal space of the first passage body into a preset number of spaces equal to the number of the main balancers, and wherein the second passage comprises:

a second passage body provided between the first passage body and the balancer body, extended toward the laundry introduction hole from the front surface of the drum;

a second flange bent toward the drum introduction hole from the second passage body to provide a space through which the liquid injected by the supplier is drawn into the second passage body; and a second passage partition wall provided in the second passage body, inserted in the front inlet hole of each main balancer, to partition off an internal space of the second passage body into a preset number of spaces equal to the number of the main balancers.

14. The laundry treating apparatus of claim 13, wherein the supplier comprises:

a first outlet injecting the liquid to the first passage;

a first valve controlling the first outlet to be opened and closed;

a second outlet injecting the liquid to the second passage;

a second valve controlling the second outlet to be opened and closed;

a third outlet injecting the liquid to the sub balancer; and a third valve controlling the third outlet to be opened and closed.

* * * * *